US007581544B2

(12) United States Patent
Gueret

(10) Patent No.: US 7,581,544 B2
(45) Date of Patent: Sep. 1, 2009

(54) APPLICATOR AND A DEVICE FOR APPLYING A COSMETIC

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 11/436,622

(22) Filed: May 19, 2006

(65) Prior Publication Data

US 2006/0272670 A1 Dec. 7, 2006

Related U.S. Application Data

(60) Provisional application No. 60/689,524, filed on Jun. 13, 2005.

(30) Foreign Application Priority Data

May 25, 2005 (FR) ..... 05 51363

(51) Int. Cl.
*A45D 29/18* (2006.01)

(52) U.S. Cl. ..... 132/74.5

(58) Field of Classification Search ..... 132/218, 132/317, 318, 320, 74.5; 401/119, 120, 125–130
See application file for complete search history.

(56) References Cited

U.S. PATENT DOCUMENTS

| | | | | |
|---|---|---|---|---|
| 2,173,959 | A * | 9/1939 | Britt | 401/128 |
| 3,739,789 | A | 6/1973 | Cataneo et al. | |
| 4,428,388 | A * | 1/1984 | Cassai et al. | 132/218 |
| 4,841,996 | A * | 6/1989 | Gueret | 132/320 |
| 4,854,759 | A * | 8/1989 | Morane et al. | 401/119 |
| 6,026,823 | A * | 2/2000 | Gueret | 132/218 |
| 6,220,254 | B1 * | 4/2001 | Gueret | 132/313 |
| 2005/0196220 | A1 | 9/2005 | Gueret | |

FOREIGN PATENT DOCUMENTS

| | | |
|---|---|---|
| EP | 1 563 759 A1 | 8/2005 |
| FR | 2155688 | 5/1973 |

* cited by examiner

*Primary Examiner*—Robyn Doan
*Assistant Examiner*—Rachel R Steitz
(74) *Attorney, Agent, or Firm*—Oliff & Berridge PLC

(57) ABSTRACT

An applicator for applying a fluid composition may include: a sheath; a stem extending, at least in part, inside the sheath, a gap being formed between the sheath and the stem; and an applicator element carried by the stem. A shape of the gap between the sheath and the stem may be modifiable by a user in such a manner as to enable the applicator element to take on at least a first configuration in which a fluid composition in the gap is retained by capillarity, and a second configuration that encourages the fluid composition in the gap to flow over the applicator element.

27 Claims, 8 Drawing Sheets

Fig.1
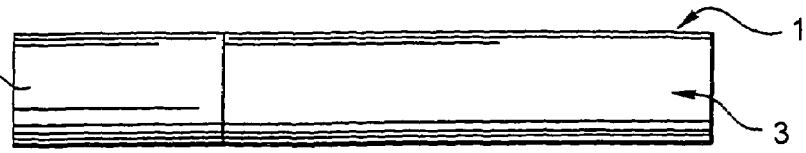
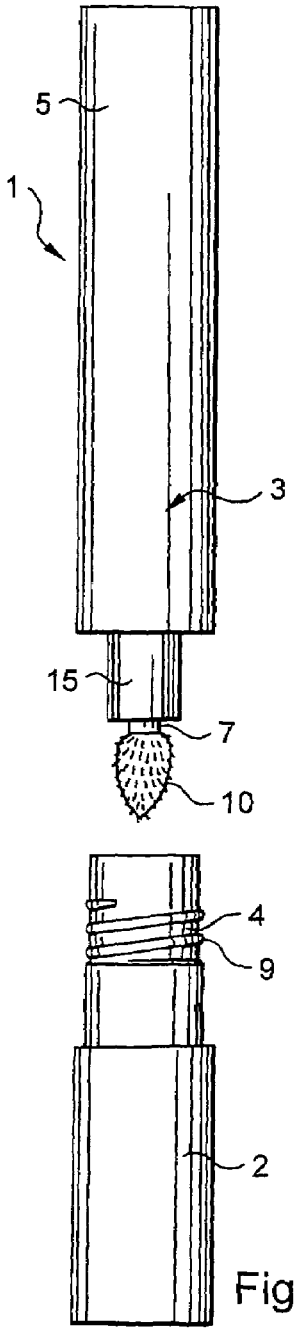
Fig.2
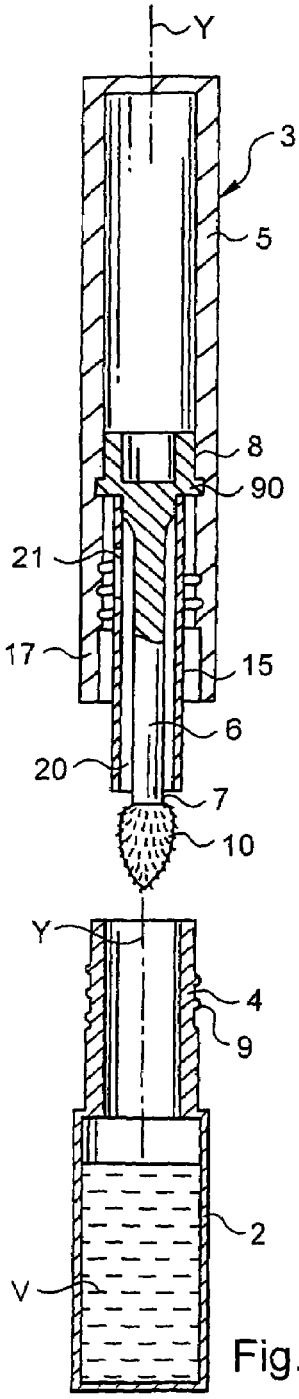
Fig.3
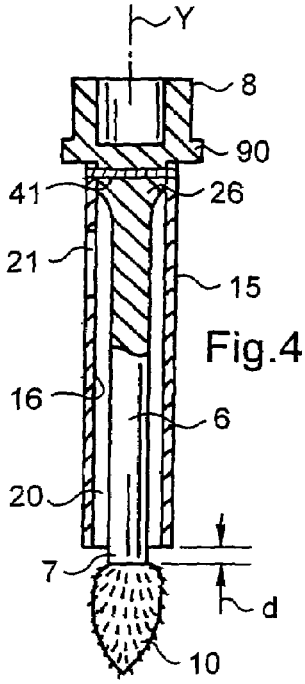
Fig.4
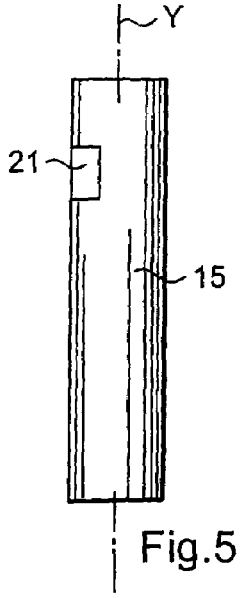
Fig.5

Fig.13
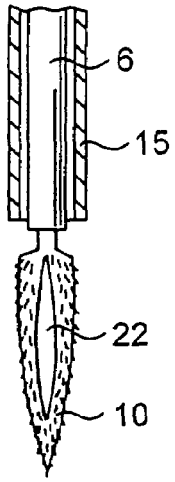
Fig.14
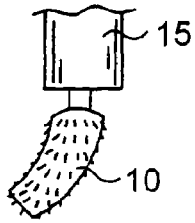
Fig.14A
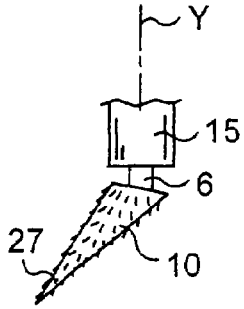
Fig.15
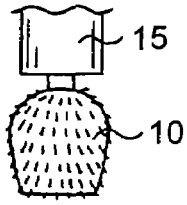
Fig.16
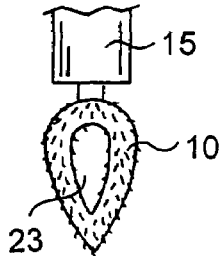
Fig.17
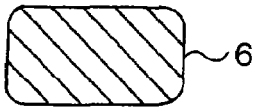
Fig.18
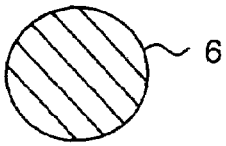
Fig.19
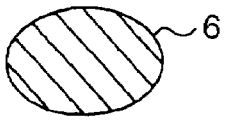
Fig.20
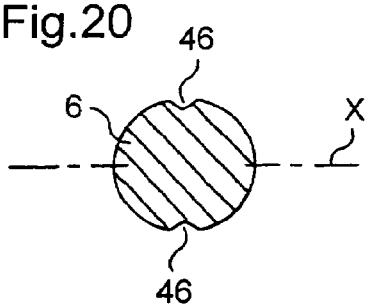
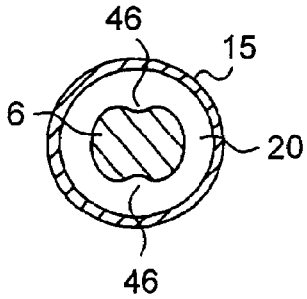
Fig.21

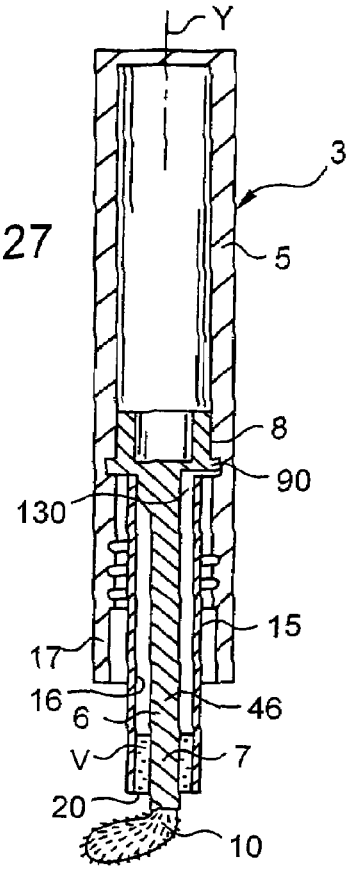
Fig.27
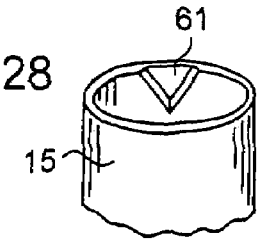
Fig.28
Fig.29
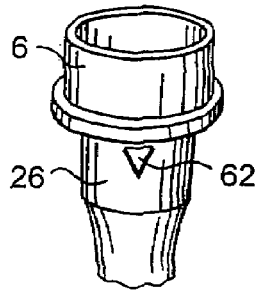
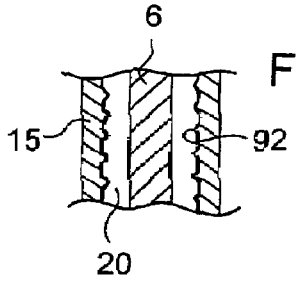
Fig.30
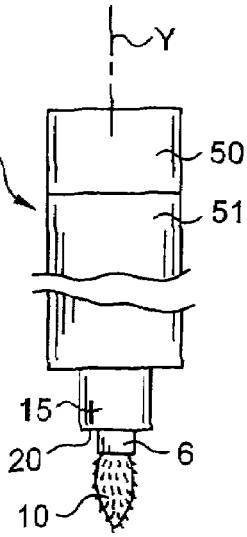
Fig.31
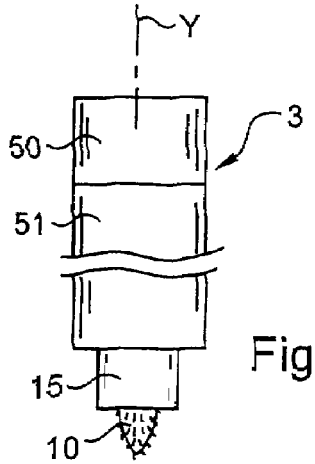
Fig.32

Fig.33
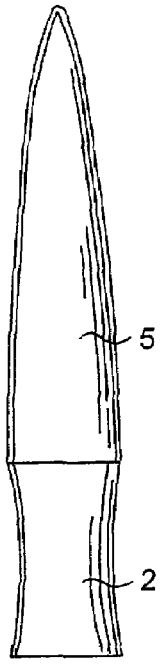
Fig.34
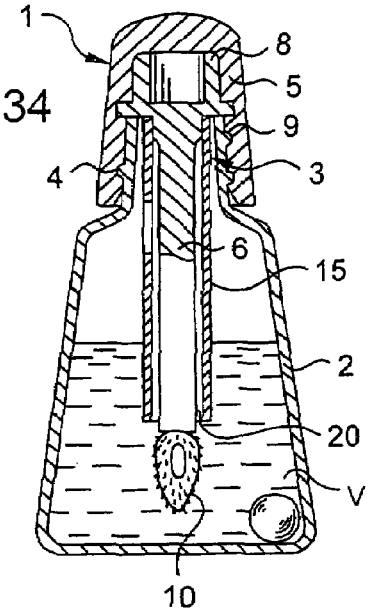
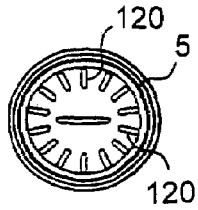
Fig.38
Fig.35
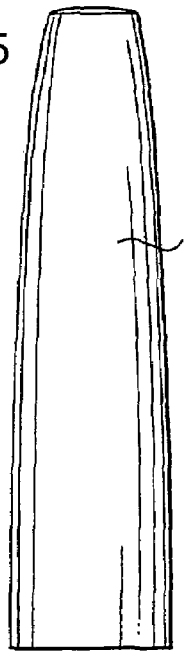
Fig.36
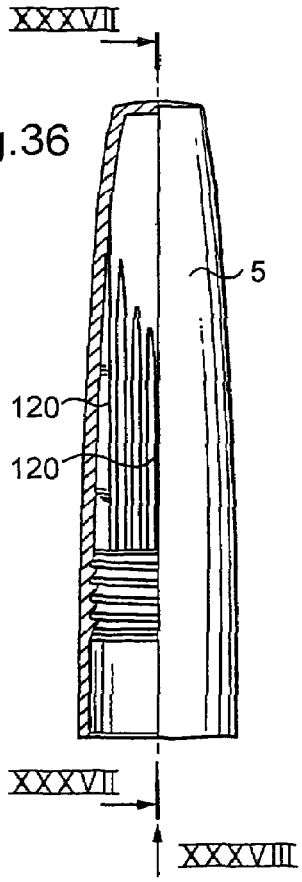
Fig.37
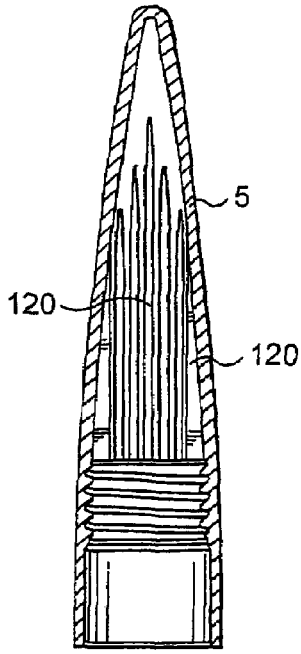

Fig.39
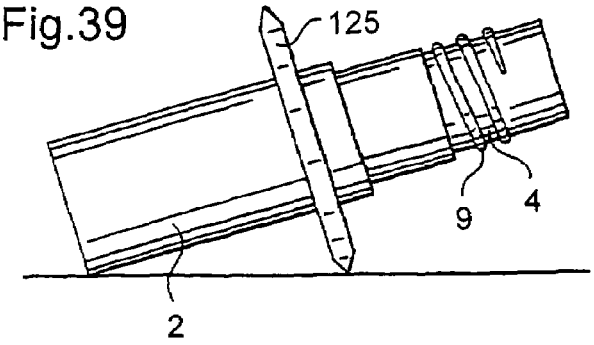
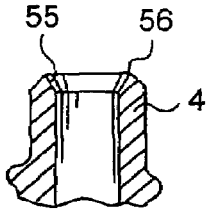
Fig.40
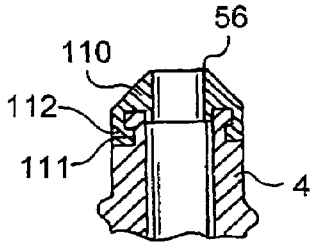
Fig.41
Fig.42
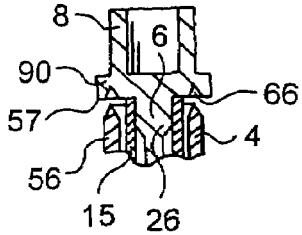
Fig.43
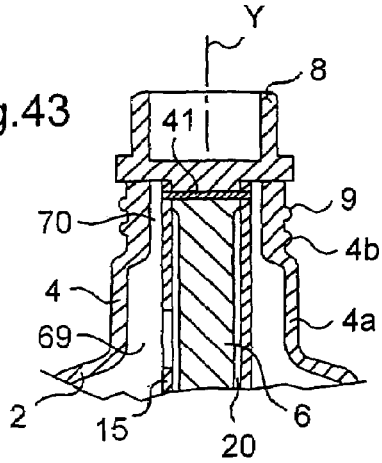
Fig.44
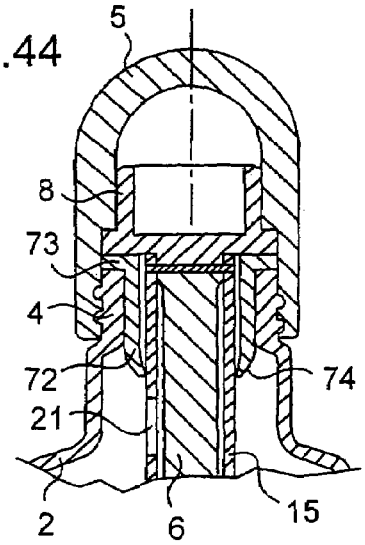

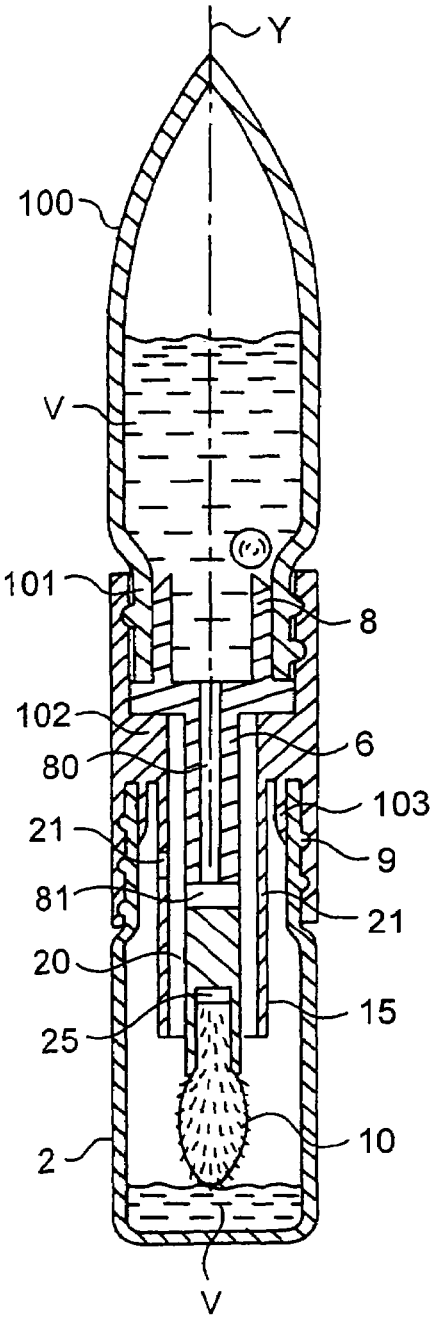
Fig.45
Fig.46
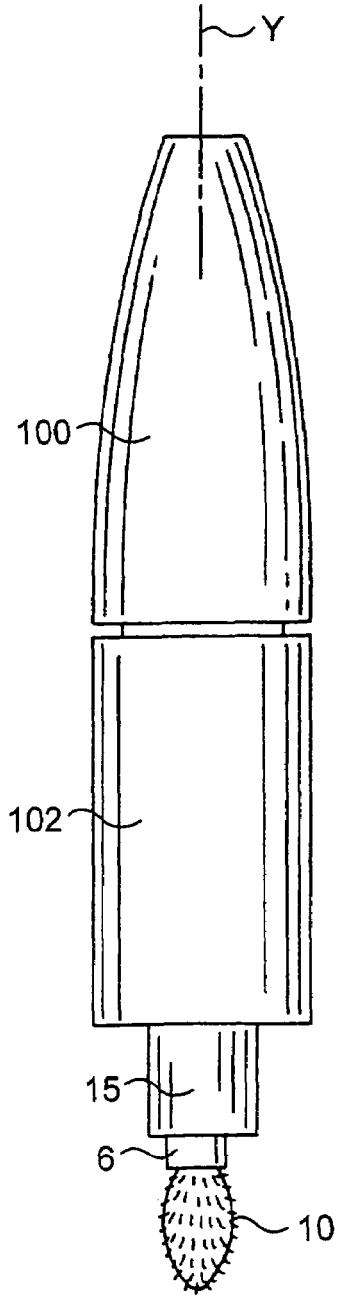

APPLICATOR AND A DEVICE FOR APPLYING A COSMETIC

CROSS-REFERENCE TO RELATED APPLICATIONS

This non-provisional application claims the benefit of French Application No. 05 51363 filed on May 25, 2005, and U.S. Provisional Application No. 60/689,524 filed on Jun. 13, 2005, the entire disclosures of which are incorporated herein by reference.

The present invention relates to applicators for applying a liquid composition, for example, makeup or a care product.

BACKGROUND

U.S. Pat. No. 4,841,996 describes an applicator for applying a liquid composition, for example, nail varnish, the applicator including reserve means for supplying composition, so as to supply bristles of a brush when the brush is removed from the receptacle containing the composition.

SUMMARY

There exists a need to have an applicator that enables a user to control a supply of composition to an applicator element, for example, as a function of a quantity of composition that is to be delivered at a selected moment, for example, to skin, nails, or any other region of a body to be treated or to be made up.

Exemplary embodiments of the invention may provide an applicator comprising: a sheath; a stem extending, at least in part, inside the sheath, a gap being formed between the sheath and the stem; and an applicator element carried by the stem; a shape of the gap between the sheath and the stem being modifiable by a user in such a manner as to enable the applicator element to take on at least a first configuration in which a fluid composition in the gap is retained by capillarity, and a second configuration that encourages the fluid composition in the gap to flow over the applicator element.

Depending on the configuration in which the applicator element is put, the user may thus act on a quantity of composition picked up by the applicator, thereby making it possible to apply makeup or to carry out a treatment more accurately and/or with a greater or lesser amount of composition.

While passing from the first configuration to the second configuration, at least one dimension of the gap may change, such that a quantity of composition in the gap and retained by capillarity in the first configuration may flow over the applicator element in the second configuration, by interrupting retention by capillarity.

A quantity of composition between the sheath and the stem may also be expelled toward the applicator element by the stem moving relative to the sheath, where appropriate or desired.

By using various exemplary embodiments, it is possible to load the applicator element with a fluid composition that is not very viscous, and to apply the fluid composition, once the sheath is filled, in an optionally continuous manner, without having to reload the applicator with composition, and while controlling an amount of composition that is supplied to the applicator element.

The shape of the applicator element may influence a speed at which the applicator element is loaded with composition.

The stem may be configured to flex inside the sheath during application, for example, to enable the applicator element to pass from the first configuration to the second configuration.

While passing from the first configuration to the second configuration, the stem may possibly come into contact with the sheath.

The term "stem" should be understood in the present invention in a broad sense, synonymous with a carrier element for carrying the applicator element. Thus, the stem may comprise one or more parts. For example, the stem may comprise a top stem portion, and a bottom stem portion, for example, of different lengths and/or diameters, of different shapes in section, and/or made of different materials.

Passage from the first configuration to the second configuration may result in at least one of the stem and of the sheath deforming elastically. Return to the first configuration may thus be automatic when the pressure exerted by the applicator on the treated region is reduced.

The top stem portion may include a housing that is configured to receive and retain the bottom stem portion, for example, by friction, snap-fastening, heat sealing, or adhesive.

The bottom stem portion may be made integrally, i.e., monolithically, with at least a portion of the applicator element, for example, with a core of the applicator element.

In exemplary embodiments in which the stem is constituted by at least two portions, the gap formed between the sheath and the stem may extend along both the top and bottom portions of the stem.

The stem may be made, at least in part, of an elastically-deformable flexible material, for example, in a vicinity of the applicator element.

The stem may also be made, at least in part, of a semi-rigid or rigid material, for example, remote from the applicator element.

In exemplary embodiments in which the stem is constituted by at least two portions, it is possible for only the bottom portion, which may be the more flexible portion, to be configured to flex inside the sheath while passing into the second configuration, the top portion remaining substantially stationary.

The stem may optionally be cylindrical, of circular or other cross-section, for example, in the vicinity of the applicator element.

The stem may include a portion adjacent to the applicator element, for example, the bottom portion of the stem, that may optionally be cylindrical and/or of circular or other cross-section.

For example, the gap between the sheath and the stem may include an annular shape of optionally constant width, the sheath and the stem each including a generally circular cross-section, with other shapes nevertheless being possible. For example, the stem may be centered relative to the sheath, in the absence of any stresses being exerted on the stem.

The applicator element may include an outer applicator surface, for example, a flocked surface, that is situated entirely outside the sheath, remote from an end of the sheath. A distance as measured along an axis of the stem between a bottom end of the sheath and a top end of the outer surface of the applicator element may not be less than 2 millimeters (mm).

In exemplary embodiments, while passing from the first configuration to the second configuration, a distance between an outer surface of the applicator element and the sheath may decrease, the applicator element possibly being able to come into contact with the sheath, depending on its deformability, for example.

The stem may include an axial position that does not change relative to the sheath. Alternatively, the stem may be movable relative to the sheath. In such embodiments, the applicator may include an actuator member that enables the stem to be displaced relative to the sheath, for example, as a function of the requirements of the user in using the device. For example, the stem may slide relative to the sheath, the stem including, or being secured to, at least one thread or lug that is configured to be screwed or slid in one or more slots or grooves formed in a portion of the applicator that is stationary relative to the sheath.

The applicator element may include a core made of plastics material, for example, thermoplastic or elastomer.

The applicator element may include a flocked outer surface. The applicator element may be different from a brush, and may comprise a foam, a felt including fibers that are oriented in a random manner or that are generally oriented in a same direction, or a sintered part, for example. The applicator element may include at least one optionally-through cavity, for example, in the form of a capillary slot.

The applicator element may include various shapes. For example, the applicator element may be elongate, optionally including a generally flat shape, may be pointed, in a shape of a spatula or an almond, may be curved, or may extend along a substantially rectilinear axis that may coincide with the longitudinal axis of the applicator. The applicator element may include a free end that is not in alignment with the longitudinal axis of the stem.

The applicator element may include a greatest transverse dimension that is less than, equal to, or greater than a greatest transverse dimension of the sheath.

The stem may be made entirely of a flexible material, or may be, at least in part, of a rigid material. Where appropriate or desired, when the stem is deformed by flexing during application, only a portion of the stem need be capable of deforming in a significant manner.

The gap between the sheath and the stem, configured to enable a composition reserve to be provided, may itself be formed in such a manner as to enable the composition to fill the gap when the sheath is immersed in the composition, for example.

An air vent may advantageously be provided, for example, in the form of at least one opening in the sheath. Air may also be vented by the way in which the sheath is mounted on the applicator. For example, a vent may be formed between the top edge of the sheath and a portion of the applicator to which the sheath is secured. A vent may also be made through the portion of the applicator on which the sheath is mounted.

The sheath may preferably include at least one lateral opening in communication with the gap between the sheath and the stem, so as to enable composition to enter into the gap and/or air to enter into and leave the gap, thereby making it easier for the gap to be filled with composition and for the composition to flow out of the gap while passing from the first configuration to the second configuration. For example, the lateral opening may includes a cross-section that is greater than 5 square millimeters ($mm^2$), or even 9 $mm^2$, for example, 16 $mm^2$.

The sheath may be rigid or flexible. For example, the sheath may be made of a material that is different from a material of the stem. Alternatively, the sheath may be made of a same material. The sheath and the stem may be made integrally, i.e., monolithically, by molding, where appropriate or desired.

Over at least a fraction of its length, the sheath may include an inside surface and/or an outside surface that is/are completely smooth. For example, the sheath may include no annular flange or groove on an inside surface thereof. For example, the sheath may be smooth on its inside surface, and the stem may include portions in relief such as ribs or other roughnesses. Alternatively, the inside surface of the sheath may include portions in relief such as ribs, for example. A shape of the sheath and a shape of the stem may be adapted to a nature of the composition.

The sheath may be secured to the stem by stapling or by some other method, it being possible for the sheath to be secured axially relative to the stem, as described above. For example, the sheath may be adhesively bonded or heat-sealed onto the stem. The sheath may also be retained on the stem by friction, stamping, and/or snap-fastening.

The sheath may optionally be cylindrical and/or of circular or other cross-section.

The sheath and the stem may include a same shape in cross-section. For example, the sheath may include a cross-section that is circular or oblong depending on whether a cross-section of the stem is circular or oblong, for example. The sheath may also include a cross-section that is circular while the stem is of oblong section, or vice versa. An outside cross-section of the sheath may be constant. The sheath may include a changing shape, for example, a varying inside cross-section, varying from a circular cross-section to an oblong cross-section, for example. The sheath may include an inside cross-section that tapers toward the applicator element. Where appropriate or desired, the cross-sections of the sheath and of the stem may be substantially similar, for example, both being oblong over at least a fraction of the length thereof.

The stem may include a shape that tends to channel the composition flowing along the stem toward a predefined region of the applicator element, when the applicator element is in the second configuration. This may enable application to be performed more neatly, for example.

The sheath and the stem may include cross-sections including different shapes so that the spacing between the sheath and the stem varies around a circumference thereof.

At least in a vicinity of an end thereof adjacent to the applicator element, the stem may, for example, include a cross-section including an outline that includes at least one depression that locally increases the width of the gap between the stem and the sheath.

The stem may include a top portion including a housing for receiving and retaining a bottom portion of the stem supporting the applicator element. The housing may include an opening of circular or oblong cross-section with a long axis. The depression may thus be situated substantially mid-way along the long axis of the housing when the stem is observed in cross-section. The stem may include a wall of varying or constant thickness around the housing serving to secure the applicator element.

The stem may include at least one optionally-rectilinear groove extending along at least a fraction of its length, for example, a groove that is helical, or else two grooves situated opposite each other, for example. The groove(s) may contribute to guiding the flow of composition along the stem when the applicator element is in the second configuration. The groove(s) may advantageously open axially at the end of the stem or the sheath situated beside the applicator element.

The depression may include a wide variety of shapes, for example, with or without rounded bottoms. The shape of the depression may vary along the length of the stem or the sheath.

The sheath and the applicator element may be arranged in such a manner that the applicator element may pass into the sheath, for example, while the applicator is being assembled. The applicator element may be configured to be deformed to pass into the sheath.

Exemplary embodiments of the invention may provide a device for applying a composition, for example, to skin or nails, comprising a receptacle containing the composition to be applied, and an applicator as defined above.

The device may include a closure cap supporting the stem, and the receptacle may include a threaded neck, the closure cap including a threaded mounting skirt configured to be screwed onto the neck.

The device may include a wiper member.

The neck may include a free edge that may form a sharp edge so as to make it easier to wipe the applicator element. The stem may include a plate including, for example, an annular groove in which the sharp edge is engaged. The neck may be surmounted by an add-on piece forming the sharp edge. The add-on piece may be secured to the neck of the receptacle in various ways, for example, by snap-fastening.

The closure cap may include a length that is greater than the length of the stem and/or greater than the length of the receptacle. In exemplary embodiments in which the closure cap also constitutes a handle, a closure cap that is relatively long may make application more comfortable, and may enable the applicator to be handled differently.

The neck may be relatively long, for example, thereby reducing a risk of the neck thread becoming clogged by composition that has dried out. Where appropriate or desired, a long neck may also enable the closure cap to be made with a mounting skirt that is sufficiently long to mask the lateral opening(s) formed in the sheath.

The sheath may include a radial clearance relative to the receptacle when the applicator is in place on the receptacle, and, for example, clearance of not less than 0.5 mm. In such case, the top end of the sheath may include an outside diameter that is less than an inside diameter of the neck.

The closure cap may include a plurality of fins disposed on an inside face of the closure cap, the fins serving to secure the stem, and, for example, being configured to receive a tubular-shaped mounting endpiece at the top end of the stem.

The device may include an outer ring projecting from the outside surface of the receptacle, such a ring being retained on the receptacle by friction, for example. The ring may be positioned on the receptacle in such a manner as to keep a level of the liquid inside the receptacle below a level of the opening of the receptacle when the receptacle rests on a horizontal surface via a bottom thereof and via the ring.

The device may also include a sleeve, for example, an elastomer sleeve, that is fitted on the receptacle, and that is retained thereon by friction, for example. Such a sleeve may make it easier to hold the receptacle, for example.

Exemplary embodiments of the invention may provide a method of applying a composition to an application surface using an applicator as defined above, the method comprising: enabling the applicator element to take on the first configuration; placing the applicator element against the application surface; and enabling the applicator element to take on the second configuration.

For example, such a method may apply to caring for or to making up nails or skin, for example, to draw a pattern.

BRIEF DESCRIPTION OF THE DRAWINGS

Various details of the present invention may will be better understood on reading the following detailed description of non-limiting embodiments, and on examining the accompanying drawings, in which:

FIG. 1 is a diagrammatic side view of an exemplary composition applicator device, shown with the receptacle being closed;

FIG. 2 shows the device of FIG. 1 after the receptacle has been opened;

FIG. 3 is a longitudinal cross-sectional view of the device of FIG. 2;

FIG. 4 is a diagrammatic axial cross-sectional view showing, in isolation, the stem and the sheath of FIG. 3;

FIG. 5 is a diagram showing the sheath of FIG. 3, in isolation;

FIGS. 9 to 16 are diagrams showing other exemplary applicator elements;

FIGS. 17 to 20 are diagrams showing different exemplary of cross-sections of the stem;

FIG. 21 is a cross-sectional diagram showing the stem and the sheath of an exemplary applicator;

FIG. 27 is a view similar to FIG. 22 showing another exemplary embodiment;

FIGS. 28 and 29 illustrate the possibility of making the stem and the sheath with complementary portions in relief;

FIG. 30 is a fragmentary and diagrammatic longitudinal cross-sectional view illustrating the possibility of making the sheath with portions in relief on an inside surface thereof;

FIGS. 31 and 32 are diagrams illustrating the possibility of making the stem movable relative to the sheath;

FIGS. 33 and 34 are diagrams showing other exemplary devices;

FIG. 35 is a diagram showing an exemplary closure cap, in isolation;

FIG. 36 is a diagrammatic and fragmentary longitudinal cross-sectional view of the FIG. 35 cap;

FIG. 37 is a diagrammatic and longitudinal cross-sectional view taken along XXXVII-XXXVII of FIG. 36;

FIG. 38 is a diagrammatic plan view seen looking along XXXVIII of FIG. 36;

FIG. 39 is an elevation view showing another exemplary receptacle;

FIGS. 40 and 41 are diagrammatic and fragmentary axial cross-sectional views showing exemplary embodiments of the neck of the receptacle;

FIG. 42 is a fragmentary longitudinal cross-sectional view of another exemplary embodiment of the stem;

FIG. 43 is a fragmentary longitudinal cross-sectional view illustrating the possibility of making the receptacle with a widened neck;

FIG. 44 is a fragmentary longitudinal cross-sectional view illustrating the possibility of providing the receptacle with a wiper member;

FIG. 45 is a diagram in longitudinal cross-sectional view showing another exemplary applicator device; and FIG. 46 is a diagram in elevation showing the applicator of FIG. 45, in isolation.

DETAILED DESCRIPTION OF EMBODIMENTS

Figure 6:
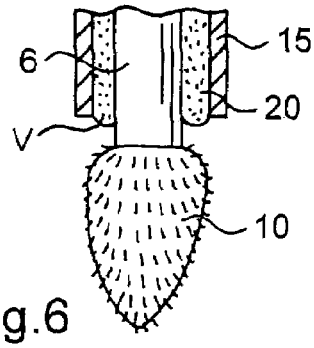
FIG. 6 illustrates composition being retained by capillarity between the stem and the sheath in the device of FIGS. 1 to 5.

The exemplary packaging and applicator device 1 shown in FIGS. 1 to 3 may comprises a receptacle 2 and an applicator 3 secured in a removable manner on the receptacle 2.

In the exemplary embodiment shown, the receptacle 2 may contain a nail varnish V, but it is contemplated that the composition receptacle 2 may be some other fluid composition, cosmetic, or care product.

The receptacle 2 may be made of any material that is compatible with the composition contained therein. For example, the receptacle 2 may be of a material selected from the group constituted by: glass; metal; plastics, for example, Barex®; polyolefins, for example, polyethylene, polyethylene/ethylvinyl alcohol/polycarbonate (PE/EVOH/PC), or polyethylene/ethylvinyl alcohol/nylon® (PE/EVOH/NYLON®), this list not being limiting.

In the exemplary embodiment shown, the receptacle 2 may include, in a top portion thereof, a neck 4 of longitudinal axis Y and provided with an outside thread 9 on which a mounting skirt 17 of a closure cap 5 may be screwed. The closure cap may also serve as a handle for the applicator.

For example, a length of the closure cap 5 may be greater than a length of the receptacle 2.

At a bottom thereof, the applicator 3 may include a stem 6 including an end portion 7 supporting an applicator element 10 that is formed by a flocked endpiece, for example, in the exemplary embodiment shown.

At a top thereof, the stem 6 may include a sleeve 8 for securing in the closure cap 5 by snap-fastening and/or by friction, for example. In the exemplary embodiment shown, the sleeve 8 may include a plate 90 which may be arranged to come to bear against a top end edge of the neck 4 when the closure cap 5 is screwed on completely.

A tubular sheath 15 carried by the stem 6 may surround the stem. In the exemplary embodiment shown, the stem 6 may extend downward beyond the sheath, the applicator element 10 not being surrounded by the sheath.

As shown in FIG. 4, the portion of stem that is not surrounded by the sheath may extend along the axis Y over a non-zero distance d, for example, that is not less than 1 mm, indeed not less than 2 mm. An annular gap 20 may be formed between the stem 6 and the inside surface 16 of the sheath 15.

The sheath 15 may include at least one lateral opening 21 in communication with the annular gap 20 and opening outward to face the mounting skirt 17. The mounting skirt 17 may preferably be sufficiently long to mask the lateral opening(s) 21 so as to improve appearance. In other exemplary embodiments (not shown), the lateral opening(s) 21 may open at a point outside the mounting skirt 17 and be visible.

In the embodiment shown, the sheath 15 may be flexible, but it is also contemplated that the sheath may be rigid.

The sheath 15 may be made of an optionally transparent material that is different from a material of the stem 6, and may includes a circular cross-section, in the embodiment shown. In the exemplary embodiment shown, the stem 6 may also include a circular cross-section, and a top end thereof may include a widened portion 26 that is connected to the sleeve 8. The sheath 15 may bear against the widened portion 26.

The sheath 15 may be secured onto the stem 6, for example, by at least one staple 41 inserted into the widened portion 26, as shown in FIG. 4. It is contemplated that the staple 41 may be disposed at some other location on the sheath 15, or that the sheath may be secured in some other way onto the stem 6, for example, by adhesion, welding, clamping, snap-fastening, or by some other technique. For example, the sheath 15 may be made integrally, i.e., monolithically, as a single piece with the stem 6, for example, in a same material.

While assembling the applicator, the sheath and the stem may be assembled together by passing the entire stem inside the sheath as far as the plate 90. The applicator element 10 may be pre-assembled on the stem 6 in such a manner that, where appropriate or desired, the applicator element 10 is capable of being deformed while passing inside the sheath 15.

For example, the lateral opening 21 may include a cross-section that is polygonal, for example, square or rectangular, as shown in FIG. 5. The cross-section of the lateral opening 21 may advantageously be large enough for the composition V to flow through easily. For example, the cross-section of the lateral opening or the sum of the cross-sections of the lateral openings may exceed 5 $mm^2$, better 9 $mm^2$, better still 16 $mm^2$, or even 20 $mm^2$ or 25 $mm^2$. In the exemplary embodiment shown, the lateral opening 21 may include a side of substantially 5 mm.

Before application, the receptacle 2 may be shaken with the closure cap 5 in place, thereby causing more composition V to penetrate into the gap 20.

Figure 7:
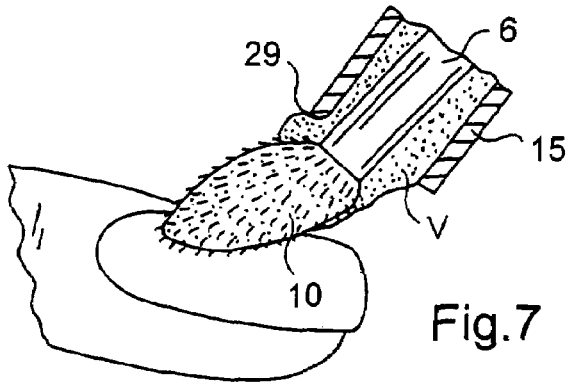
FIG. 7 is a diagram illustrating composition being applied to a nail.

The applicator may be used as illustrated in FIGS. 6 and 7.

The composition contained in the gap 20 between the sheath 15 and the stem 6 may be retained by capillarity, as shown in FIG. 6, in a first configuration of the applicator element 10 corresponding to the configuration that the stem 6 takes on when at rest, namely, coaxial to the sheath.

To cause the composition that is retained by capillarity in the gap 20 to flow over the applicator element 10, the user may flex the stem 6, as illustrated in FIG. 7, for example, by pressing the applicator element 10 against a surface being treated.

The stem 6, that is elastically deformable in the embodiment shown, may take on a second configuration in which the shape of the gap 20 is modified. The stem 6 may come into contact with the sheath 15 while passing from the first configuration to the second configuration, depending on a force exerted by the user, for example. A portion of the gap 20 that has increased in width following the flexing of the stem is no longer able to retain the composition by capillarity. Thus, the composition may then flow toward the applicator element, as illustrated in FIG. 7. In addition, the composition may be expelled toward the applicator element 10 as a result of the stem moving toward the sheath at 29.

When the pressure exerted by the user is relaxed, the stem 6 may return to the first configuration, for example, by a resilience thereof.

Figure 8:
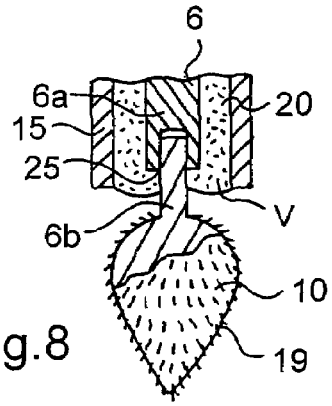
FIG. 8 is a diagrammatic and fragmentary view of another exemplary applicator.

The stem 6 may be a single part, as shown in FIGS. 1 to 7, or may be made of at least two distinct parts, as shown in FIG. 8, for example, with a top stem portion **6*a*, and a bottom stem portion 6*b* that is more flexible than the top portion 6*a***, for example.

The bottom portion **6*b* may be of diameter that is smaller than a diameter of the top portion 6*a*, with the bottom portion being housed and retained by friction in a housing 25 of the top portion 6*a***, for example.

The bottom portion **6*b* may support the applicator element 10, with the bottom portion being made integrally, i.e., monolithically, with at least a portion of the applicator element 10**, for example, and, for example, with a core of the applicator element.

In the embodiment shown in FIG. 8, the gap 20 may be made firstly between the sheath 15 and the top portion **6*a*, and secondly between the sheath and the bottom portion 6*b***.

The bottom portion 6*b* may optionally be of circular cross-section. The bottom portion 6*b* of the stem may be more flexible that the top portion 6*a*. While passing into the second configuration, it is possible for only the bottom portion 6*b* of the stem to flex in a substantial manner, whereas the top portion 6*a* may remain substantially stationary.

As shown, the core of the applicator element 10 may be covered by flocking that defines the outer application surface 19 that is used to apply the composition.

It is contemplated that the applicator element 10 may include various other forms and may be made out of different materials.

Figure 9:
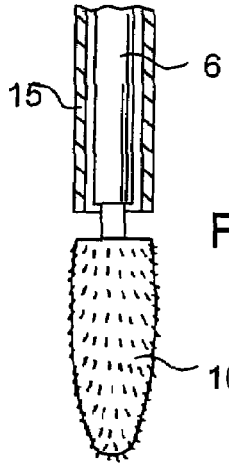

For example, FIG. 9 shows an applicator element 10 including an outer surface that is defined by a non-flocked foam.

Figure 10:
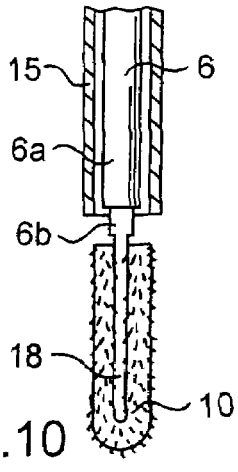

FIG. 10 shows an applicator element 10 comprising a foam carried by a core 18 that is elongate in shape, in the embodiment shown, and that is formed integrally, i.e., monolithically, with the bottom portion 6*b*.

Figure 11:
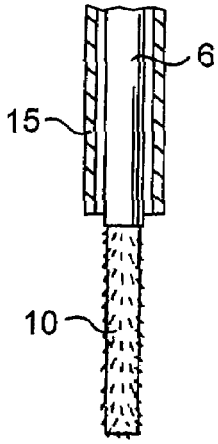
Figure 12:
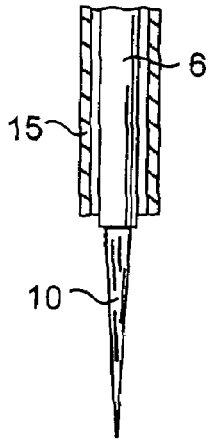

In FIG. 11, the applicator element 10 may consists of felt comprising fibers that are oriented in random manner, whereas in FIG. 12, the applicator element 10 may also comprise felt formed of fibers that are generally oriented in a same direction.

In FIGS. 11 and 12, for example, the applicator element 10 may include a greatest transverse dimension that is less than a greatest transverse dimension of the sheath 15.

The applicator element 10 may include one or more optionally-through cavities.

In the embodiment shown in FIG. 13, the applicator element 10 may include a longitudinal slot 22 that is configured to retain the composition.

FIG. 14 shows an exemplary applicator element that curves relative to the longitudinal axis Y of the applicator. FIG. 14A shows another exemplary applicator element 10 including a free end 27 that is not in alignment with the longitudinal axis Y of the stem.

As shown in FIG. 15, the applicator element 10 may be generally spatula shaped, whereas in FIG. 16, the applicator element may be almond shaped, including a central recess 23, in the embodiment shown. Also in FIG. 16, the applicator element 10 may include a greatest transverse dimension that is greater than a greatest transverse dimension of the sheath 15.

The cross-section of the stem 6 may be circular, as shown in FIG. 18, but may include still other shapes.

For example, the cross-section of the stem 6 may include an outline that is substantially polygonal, square, or rectangular, as shown in FIG. 17, or oval as shown in FIG. 19, with the shape of the stem possibly varying along a longitudinal axis thereof, passing from an oval shape to a circular shape, for example.

As shown in FIGS. 20 and 21, the stem 6 may include, over at least a fraction of its length, and, for example, over its end portion 7, at least one depression 46.

As shown in FIG. 20, for example, the stem 6 may include two opposite depressions 46. The depressions may channel the flow of composition toward a middle region of the applicator element 10, not shown.

In FIG. 21, the sheath 15 is shown co-operating with the stem 6 to form a gap 20 around an entire periphery of the stem. The gap 20 may include a dimension that varies circumferentially. For example, a width of the gap 20 may be greater at the depressions 46, thereby making it possible to provide greater reserves of composition at this location. When the stem 6 is observed in cross-section, an outline of the stem may be convex, other than at the depressions 46.

It is also possible to modify the shape of the housing 25 and/or the shape of the end portion 7 of the stem 6.

Figure 22:
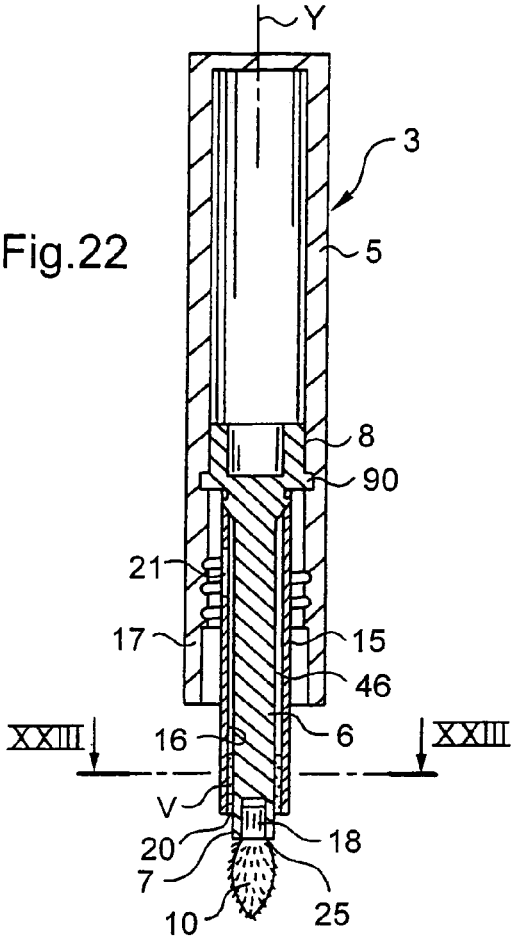
FIG. 22 is a view similar to FIG. 3 showing an other exemplary embodiment, with the receptacle not being shown.

FIG. 22 shows the sheath secured to the stem by snap-fastening, the applicator element 10 including a fastener end-piece that is completely engaged in the stem.

Figure 23:
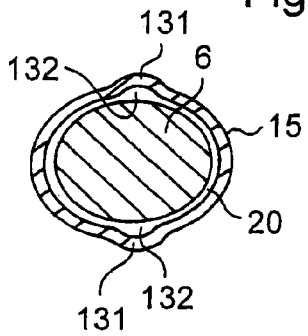
FIG. 23 is a cross-sectional view taken along XXIII-XXIII in FIG. 22.

As shown in FIG. 23, the sheath 15 may include at least one groove 131, or indeed two grooves 131, in a radially inner surface thereof, thereby creating depressions 132, the stem 6 including, in this embodiment, an outline that does not include any depression in cross-section.

In exemplary embodiments not shown, both the sheath and the stem may include respective depressions in cross-section.

Figure 25:
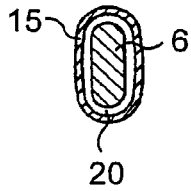
FIG. 25 is a cross-sectional view taken along XXV-XXV of FIG. 24.
Figure 24:
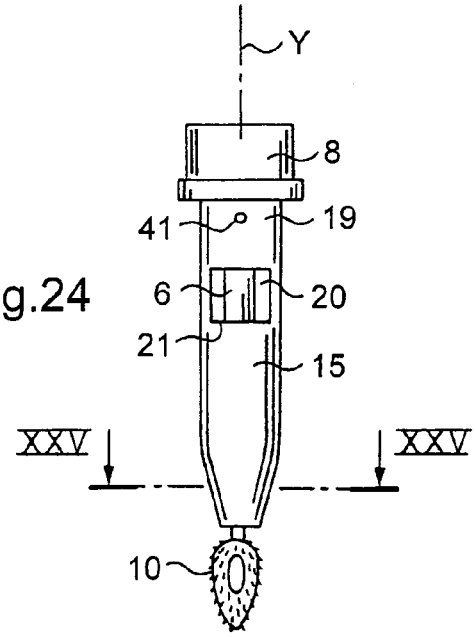
FIG. 24 is an elevation view of an exemplary embodiment in which the sheath surrounds a stem of oblong cross-section.

As shown in FIGS. 24 and 25, the stem 6 may include an oblong cross-section over at least a fraction of its length from a bottom end thereof.

At a top portion thereof, the sheath 15 may include a circular cross-section configured to fix onto the circularly-cylindrical widened portion 26 of the stem 6, and at a bottom portion thereof, a non-circular cross-section configured to a shape of the stem 6, as shown in FIG. 25.

Figure 26:
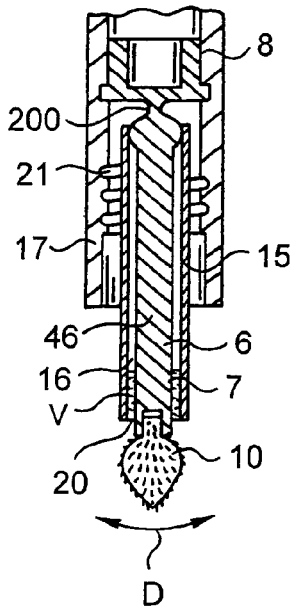
FIG. 26 is a diagrammatic and fragmentary longitudinal cross-sectional view of another exemplary embodiment.

FIG. 26 illustrates the possibility of making the applicator with a hinge 200, making it possible for the stem and the sheath to pivot over a certain angle D during use.

For example, the hinge 200 may comprise a film-hinge, or a wire-shaped or hourglass-shaped narrowing of a portion of the stem, for example, the portion connected to the sleeve 8.

The hinge may also be made in some other way, for example, with a swivel ball or one or more pivot pins.

In the embodiment shown, the sheath may be fastened to the stem below the hinge, and may pivot, at least in part, with the stem.

During use, application may be made more comfortable by sloping the stem.

Air in the gap between the sheath and the stem may be vented other than by passing through lateral openings 21.

For example, FIG. 27 shows an applicator including a sheath 15 that does not include lateral openings. The stem 6 may include a notch extending axially between both the sheath and the stem, and radially below the plate 90, but above the top edge of the sheath, forming a vent 130 that enables air to be vented when the bottom end of the sheath is immersed in the composition.

FIG. 27 also illustrates the possibility of making the applicator element 10 on a slope relative to the longitudinal axis Y of the applicator 3, the free end of the applicator element being offset relative to the longitudinal axis of the stem.

Where appropriate or desired, to facilitate an angular positioning of the sheath 15 relative to the stem 6 while the sheath 15 is being assembled on the stem 6, additional portions in relief 61 and 62 may be provided on the stem 6 and the sheath 15 respectively, as shown in FIGS. 28 and 29.

For example, the portion in relief 62 may be in the form of a triangularly-shaped projection projecting from the widened portion 26 of the stem 6, while the portion in relief 61 may be in the form of a notch, that is also triangularly-shaped, formed in a thickness of the sheath 15 and opening on its inside surface and its top end.

FIG. 30 illustrates the possibility of making the sheath with portions in relief 92 on its inside surface, the portions in relief comprising annular ribs, for example.

The stem may be stationary relative to the sheath, as shown in FIGS. 1 to 6, for example. Alternatively, the stem 6 may be movable relative to the sheath 15, as shown in FIGS. 31 to 32, for example. In this case, the stem 6 may occupy at least two positions, shown in FIGS. 31 and 32, respectively, namely, a low position shown in FIG. 31 in which the stem is visible in part, and a high position shown in FIG. 32 in which the stem 6 is no longer visible, the sheath 15 thus surrounding the applicator element 10 over a fraction of its height.

In this exemplary embodiment, the applicator 3 may include an actuator member 50 that enables the stem to be displaced relative to the sheath, and that may be turned relative to a bottom part 51 that is stationary relative to the sheath 15.

For example, the stem may include, or be secured to, an element including a thread or a lug, and the bottom portion 51 may include one or more corresponding slots or grooves.

When the actuator member 50 is turned relative to the bottom portion 51, the co-operation of the thread or of the lug with the complementary portion in relief of the bottom portion 51 may cause the stem to be displaced axially upward or downward as a function of the direction of turning.

In this exemplary embodiment, the user may select a mode of use of the applicator. In the low position shown in FIG. 31, the flow may be interrupted, with composition being retained by capillarity in the gap 20 between the sheath and the stem in the first configuration, the composition being able to flow while passing into the second configuration as a result of the shape of the gap 20 being modified, for example, by flexing the stem when the applicator element 10 is applied to the surface to be treated.

The high position shown in FIG. 32 may enable the composition contained in the gap 20 to flow continuously over the applicator element surrounded by the sheath.

It is contemplated that the receptacle 2 containing the composition to be applied may include a different shape, for example, as shown in FIGS. 33 and 34.

In FIG. 33, the receptacle 2 may include a waisted shape including an outside cross-section that, from the bottom, tapers in toward the center, then flares out again toward the top, thereby making it easier to hold.

The waisted shape may be the shape of the receptacle 2 itself, or may be the shape of a sleeve, for example, an elastomer sleeve, that is fitted on the receptacle 2, which is itself substantially cylindrical, for example.

In FIG. 34, the receptacle 2 may include a conventional shape, and may contain a ball for homogenizing the composition V.

In the exemplary embodiment shown in FIGS. 35 to 38, the closure cap 5 may include an elongate shape that is flat at a top end thereof.

An inside face of the cap 5 may include a plurality of fins 120 including different lengths, in the embodiment shown.

The fins 120, shown in FIGS. 35 to 38, may make it easier to secure the sleeve 8, for example, by friction.

In the exemplary embodiment shown in FIG. 39, the receptacle 2 may be provided, on an outside surface thereof, with a ring 125, for example, an elastomer ring, that is retained on the receptacle 2 by friction, for example.

The ring 125 may make it easier to hold the receptacle 2, and/or to enable the open receptacle to be put down on a horizontal surface without the composition contained in the receptacle 2 flowing out of the receptacle.

The neck 4 which does not have a wiper, may include, at a top end thereof, a free edge that may be flat or that may include a sharp edge 56, as shown in FIG. 40.

The inclusion of a sharp edge ensures that the receptacle is sealed by coming into contact with a bottom face 57 of the sleeve 8 of the stem 6. In addition, when removing the applicator 3 from the receptacle 2, the user may wipe the applicator element 10 loaded with composition against the free edge 55 of the neck 4. Because of the sharp edge 56, the composition may flow into the receptacle 2. The sharp edge 56 may include various shapes.

Alternatively, as shown in FIG. 41, the sharp edge 56 may be formed on a piece 110 fitted on the neck 4 of the receptacle.

Such an add-on piece 110 may be secured on the neck 4 by snap-fastening, the neck including an outer annular groove 111, for example, and the piece 110 including a corresponding inwardly-directed flange 112.

The add-on piece 110 may be made of plastics material, for example.

Where appropriate or desired, and in exemplary embodiments in which the neck includes a sharp edge 56, a groove 66 may be made in the bottom face 57 of the plate 90 of the sleeve 8, to receive the sharp edge 56, as shown in FIG. 42. This may further improve the sealing of the receptacle when closed.

The neck 4 may be made with a shoulder giving the neck 4 a widened shape so as to provide an additional gap between the inside surface of the receptacle 2 and the sheath 15 at the opening 21, as shown in FIG. 43, and thus make it easier to fill the gap 20 with composition penetrating through the opening 21.

In the exemplary embodiment shown in FIG. 43, the neck 4 may be made with a widened bottom portion 4*a* which co-operates with the sheath 15 to form an annular gap 69 that is wider than the gap 70 existing between the sheath 15 and the thread-carrying top portion 4*b* of the neck 4.

In use, the composition V may reach the lateral opening 21 by flowing through the passage 69, for example, when the user shakes the receptacle 2 up and down.

FIG. 44 illustrates the possibility of making the receptacle 2 with a wiper member 72, for example, inserted into the neck 4 and coming to bear via a rim 73 against the top end of the neck 4.

The wiper member 72 may include an annular lip 74 which comes to bear against the outside surface of the sheath 15 above the lateral opening 21, when the receptacle 2 is closed.

In the exemplary embodiment shown in FIGS. 45 and 46, the handle of the applicator 3 may also constitute a reserve of composition V. The composition may flow into the stem 6 through a channel 80 that extends longitudinally and that opens to a transverse channel 81, itself opening outside the stem 6 in the gap 20 formed between the sheath 15 and the stem 6. Composition V may be collected in the receptacle 2 housing the applicator in the closed position of the assembly, as shown in FIG. 45. In this exemplary embodiment, the closure cap forming the handle may comprise two elements. The first element is the reservoir 100 containing the composition V, the reservoir being provided with an externally-threaded neck 101, and being configured to retain the sleeve 8 of the stem 6. The second element comprises a connection part 102 configured to connect the reservoir 100 to the receptacle 2, with the top portion of the connection part being screwed onto the reservoir 100, and with a bottom portion thereof being screwed onto the receptacle 2. In the exemplary embodiment shown, the connection part 102 may also be made integrally, i.e., monolithically, with the sheath 15. The connection part 102 may include a sealing skirt 103 configured to come to bear against the inside wall of the neck of the receptacle 2 to seal the receptacle.

The invention is not limited to the embodiments described above, and the characteristics of the various embodiments may be combined with one another, for example.

The term "comprising a" should be understood as being synonymous with the term "comprising at least one" unless specified to the contrary.

Although various details of the present invention herein have been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. An applicator for applying a fluid composition, the applicator comprising:

a sheath;

a stem extending, at least in part, inside the sheath;

an applicator element carried by the stem;

the stem extending downward beyond the sheath in a first configuration and a second configuration of the applicator element, a gap being formed between the sheath and the stem; and the shape of the gap between the sheath and the stem being modifiable by the user, in such a manner as to enable the applicator element to take on at least the first configuration in which the composition present in said gap is retained by capillarity, and the second configuration that encourages the composition contained in said gap to flow over the applicator element, wherein the applicator element comprises, in the first and second configurations an outer surface for the application of the composition which is situated entirely outside the sheath, wherein while passing from the first configuration to the second configuration, the dimensions of the gap change, such that a quantity of composition present in said gap and retained by capillarity in the first configuration can flow over the applicator element in the second configuration.

2. An applicator according to claim 1, wherein the stem is a single part.

3. An applicator according to claim 1, wherein the stem comprises at least a top portion, and a bottom portion supporting the applicator element.

4. An applicator according to claim 3, wherein the top portion of the stem comprises a housing, and wherein the bottom portion of the stem is received, at least in part, in the housing.

5. An applicator according to claim 3, wherein the top portion of the stem is substantially stationary, and wherein the bottom portion is capable of flexing inside the sheath while passing into the second configuration.

6. An applicator according to claim 1, wherein the stem presents a portion adjacent to the applicator element that is of non-circular section.

7. An applicator according to claim 1, wherein the stem is made, at least in part, of an elastically-deformable flexible material.

8. An applicator according to claim 1, wherein the stem presents an axial position that does not change relative to the sheath.

9. An applicator according to claim 1, wherein the stem is movable relative to the sheath.

10. An applicator according to claim 1, wherein the stem is capable of flexing inside the sheath.

11. An applicator according to claim 1, wherein the applicator element includes a core made of plastics material.

12. An applicator according to claim 11, wherein the core is made of thermoplastic material or of elastomer.

13. An applicator according to claim 1, wherein the applicator element has a flocked outer surface.

14. An applicator according to claim 1, wherein the applicator element comprises one of a foam, felt, and a sintered part.

15. An applicator according to claim 1, wherein the applicator element presents a greatest transverse dimension that is less than a greatest transverse dimension of the sheath.

16. An applicator according to claim 1, wherein the sheath is of circular cross-section.

17. An applicator according to claim 1, wherein the sheath is of non-circular cross-section.

18. An applicator according to claim 1, wherein the sheath presents an inside section that varies along its longitudinal axis.

19. An applicator according to claim 1, wherein the applicator element includes a free end that is not in alignment with the longitudinal axis of the stem.

20. An applicator according to claim 1, wherein the stem is of circular section.

21. An applicator according to claim 20, wherein the stem is of circular section at least in the vicinity of the applicator element.

22. An applicator according to claim 1, wherein the stem is of non-circular section.

23. An applicator according to claim 1, wherein the sheath and the applicator element are arranged in such a manner that the applicator element can pass through the sheath.

24. An applicator device for applying a composition, comprising a receptacle for containing the composition, and an applicator according to claim 1.

25. A device according to claim 24, wherein the receptacle comprises a neck comprising a free edge forming a sharp edge.

26. A device according to claim 24, further comprising a cosmetic composition contained in the receptacle.

27. A method of applying a composition to an application surface by means of an applicator as defined in claim 1, the method comprising:

enabling the applicator element to take on the first configuration;

placing the applicator element against the application surface; and enabling the applicator element to take on the second configuration.

* * * * *